United States Patent [19]

Christopherson

[11] 4,411,086

[45] Oct. 25, 1983

[54] HAND HELD, SINGLE SHOT, FIREARM

[76] Inventor: John K. Christopherson, 9180 Falcon Cir., Sandy, Utah 84070

[21] Appl. No.: 243,719

[22] Filed: Mar. 16, 1981

[51] Int. Cl.[3] ..... F41C 3/00

[52] U.S. Cl. ..... 42/1 R

[58] Field of Search ..... 42/1 R, 1 J, 1 N, 1 Z

[56] References Cited

U.S. PATENT DOCUMENTS

| | | | |
|---|---|---|---|
| 2,545,473 | 3/1951 | Kremkav | 42/1 N |
| 3,368,811 | 2/1968 | Finney | 42/1 R |
| 4,083,138 | 4/1978 | Cash | 42/1 R |
| 4,176,606 | 12/1979 | King et al. | 42/1 Z |
| 4,268,987 | 5/1981 | Cash | 42/1 R |

*Primary Examiner*—Charles T. Jordan

*Attorney, Agent, or Firm*—Mallinckrodt & Mallinckrodt

[57] ABSTRACT

A single-shot, hand-held firearm for use with a cartridge having a primer, includes a body holding one end of a barrel in which a cartridge is secured. A firing pin normally spaced from the cartridge but adapted to be moved toward the cartridge so that it strikes the primer thereof is received by a hole in the body. A barrier is secured in the hole between the cartridge and the firing pin to keep the firing pin from contacting the cartridge until a predetermined pressure is applied to the firing pin causing the firing pin to penetrate the barrier and move forward striking the primer of the cartridge with sufficient force to fire the cartridge. Pressure is conveniently applied to the firing pin through a firing pin handle. The preferred embodiment is sized to fit in a fist and to have sufficient force applied between the handle and body to fire it by squeezing the fist.

12 Claims, 5 Drawing Figures

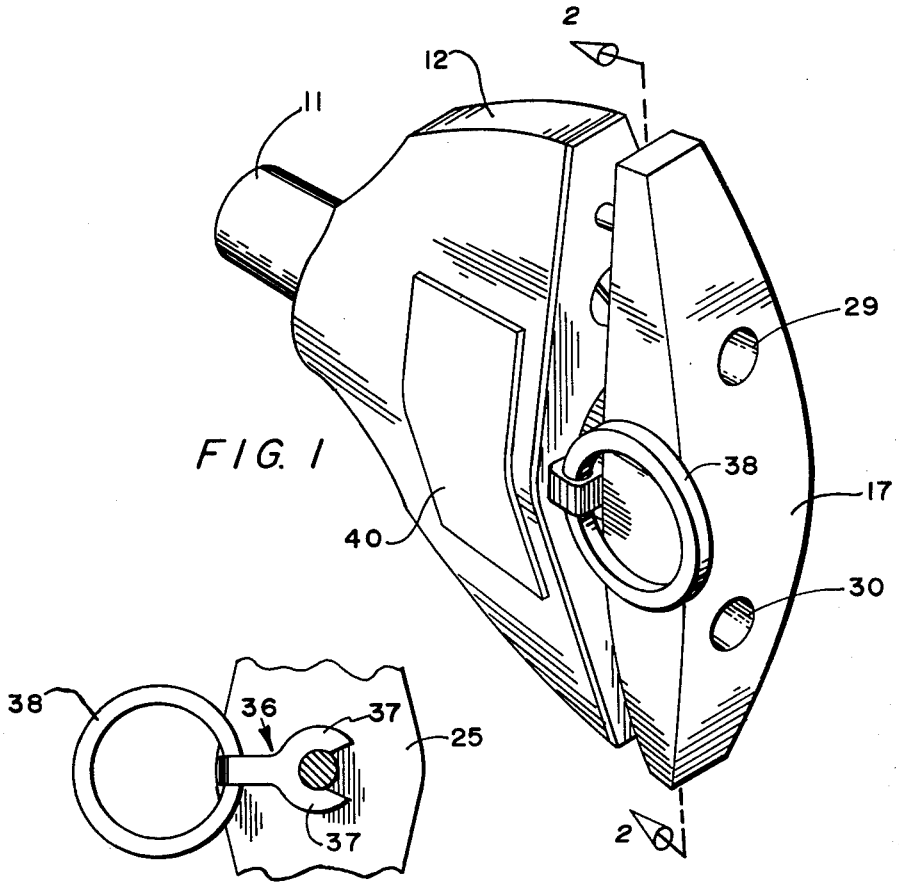
FIG. 1
FIG. 2
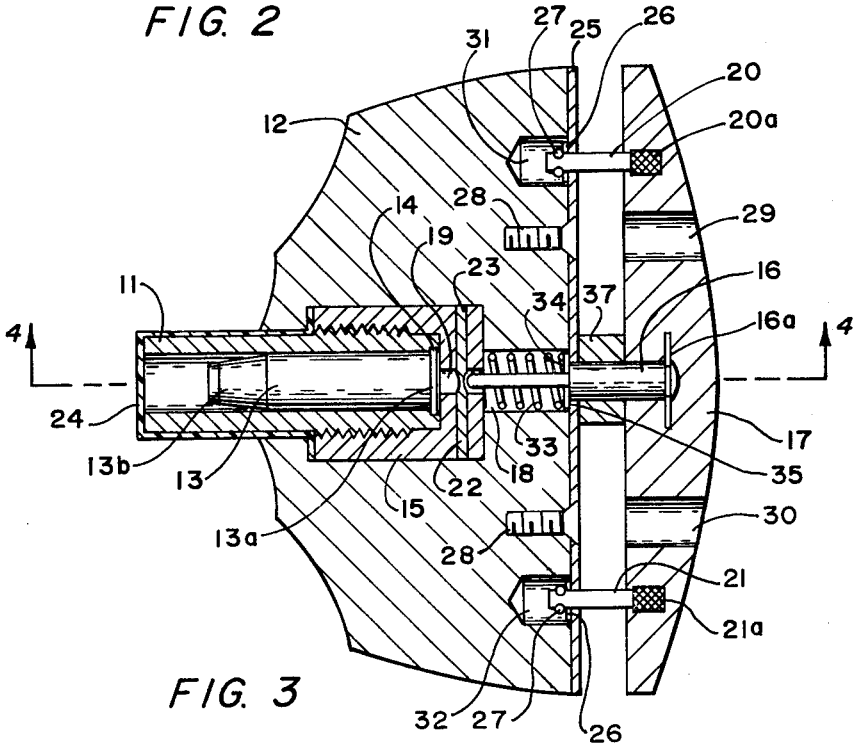
FIG. 3

HAND HELD, SINGLE SHOT, FIREARM

BACKGROUND OF THE INVENTION

1. Field:

The invention is in the field of firearms, and in particular of singleshot, hand-held firearms.

2. State of the Art:

Over the years, various handguns have been developed for use in personal protection, offering ease of concealment or ease of operation. Often, these types of handguns are designed for use at close range and accuracy has been relatively unimportant.

Modern cartridges have internal primers which are used to ignite the gunpowder contained in the cartridge. These internal primers may be integral with the cartridge casing, as in rim-fire primers, or they may be separate components received by the casing, as in center-fire primers. With either type of primer, it is necessary to strike the primer with sufficient force to cause it to detonate, thus igniting the gunpowder and causing it to explode.

Various methods have been devised to impart sufficient force to a firing pin whereby it detonates the primer. One method employs a firing pin consisting of a simple rod that is movable between a position in contact with the primer and a retracted position out of contact with the primer, and a spring to bias the firing pin in the retracted position. This type of firing pin is typically struck by a falling hammer under tension from a second spring. The hammer causes the pin to strike the primer with sufficient force to detonate it.

A second method employs a firing pin which has a cocked, retracted position, and an uncocked, extended position in contact with the primer. This type of firing pin is cocked against the force of a spring and, when released, will move to its uncocked position with sufficient force to set off the primer.

These prior methods have relied upon springs to provide the striking force necessary to detonate a primer. One problem with use of springs is that they must be forced to a position under tension and then suddenly released. If they are left in a cocked position so as to be immediately ready to fire the firearm, there is the danger that they will release accidentally, or that they will weaken and thus be incapable of imparting sufficient force to the firing pin to cause it to detonate the primer.

SUMMARY OF THE INVENTION

According to the present invention, a firearm employs a breakable or penetrable barrier interposed between the firing pin and the primer. This barrier is penetrated by the firing pin when a predetermined pressure is applied to the firing pin. After the firing pin penetrates the barrier, it continues to travel until it strikes the primer, thus causing the primer to detonate, and the gun to fire.

In a preferred embodiment of the invention, a cartridge is received and held by one end of a short barrel which is secured in a gun body designed to be held in a person's fist with the barrel protruding between the middle fingers. A firing pin is received by an aperture in the gun body and rests against a barrier secured in the aperture in spaced relationship from the primer of the cartridge. In order to easily apply pressure to the firing pin, a handle is secured thereto which is spaced from the gun body.

To fire the gun, sufficient pressure is exerted on the firing pin handle to force it toward the gun body, thereby forcing the firing pin through the barrier and impacting it against the primer. The barrier is chosen so that the firing pin will penetrate it and the gun may be fired by squeezing the handle toward the gun body when held in the palm of a hand.

THE DRAWING

In the accompanying drawing, which represents the best mode presently contemplated for carrying out the invention:

FIG. 1 is a perspective view of the device, showing the safety in place.

FIG. 2, a fragmentary vertical section taken along the line 2—2 of FIG. 1 but with the safety ring folded to a different position, showing the manner of attachment of the safety to the firing pin of the device;

FIG. 3, a longitudinal vertical section of the device;

FIG. 4, a horizontal section taken along line 4—4 of FIG. 3; and

FIG. 5, a side view of the device being held in a hand ready to fire with the safety removed.

DETAILED DESCRIPTION OF THE ILLUSTRATED EMBODIMENT

Figure 4:
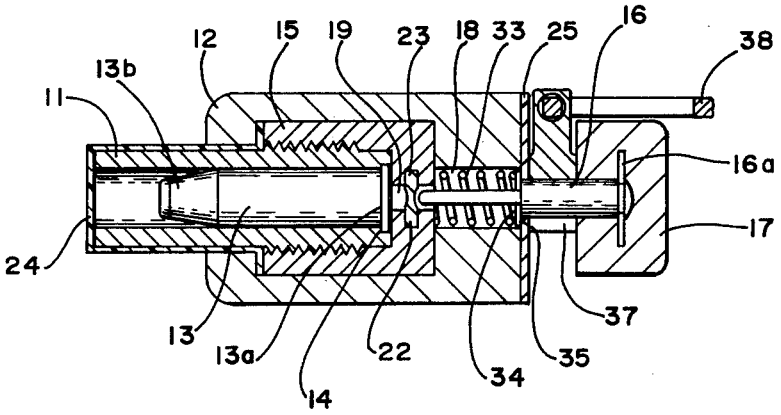

As shown in the drawings, the preferred embodiment of the gun constructed according to the invention includes a barrel 11 secured in a gun body 12. A cartridge 13 is seated in the end of the barrel 11 with cartridge lip **13*a* being received by an annular groove 14 in the barrel. The cartridge 13 is held securely in place by a cap 15 secured over the body end of the barrel. As shown in FIGS. 3 and 4**, the barrel and cap may be threaded and the cap screwed onto the barrel after the cartridge is in place.

A firing pin 16, secured to firing pin handle 17, extends through hole 18 in body 12 and into hole 19 in cap 15. Firing pin handle 17 provides a convenient means for moving firing pin 16 and is movably mounted by means of mounting pins 20 and 21 to body 12. In this way, handle 17 may be moved toward or away from body 12, such movement causing travel of firing pin 16 in holes 18 and 19 toward or away from cartridge 13.

A barrier 22 is interposed in hole 19 between cartridge 13 and firing pin 16 and normally blocks hole 19 so that firing pin 16 does not contact the cartridge. The barrier 22 may conveniently be a strip of material inserted into a groove 23, FIGS. 3 and 4, in cap 15.

The open end of barrel 11 may be covered with a thin sheath 24 which serves to protect the barrel from dirt, dust and corrosion. The sheath will be of a thin material such as a plastic so that when the firearm device is discharged, the bullet **13*b* from cartridge 13 is easily able to penetrate sheath 24**, making it unnecessary to remove the sheath before firing.

Figure 5:
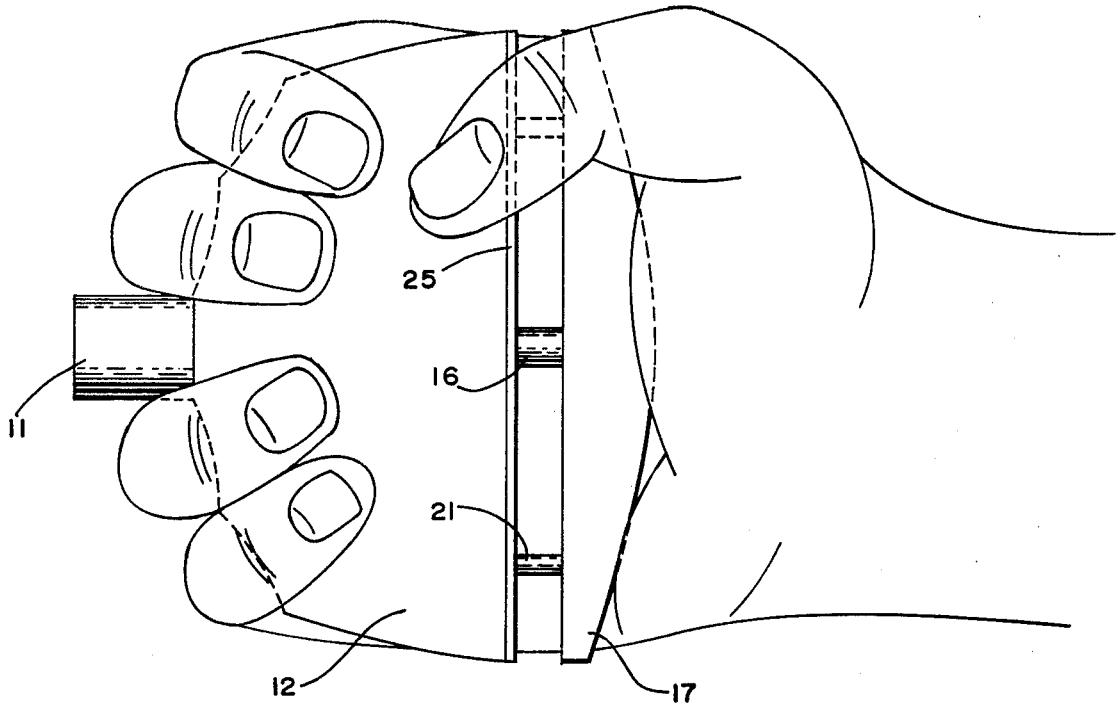

The embodiment shown is a one shot, disposible firearm and, as such, the body 12 is preferably molded of plastic around a portion of barrel 11 after the cartridge 13 has been inserted and cap 15, with barrier 22 therein, secured thereto, and sheath 24 has been put in place. The body thus holds the sheath tightly in place to permanently seal the barrel from adverse elements. Use of a plastic body adds very little weight to the gun. It is preferred that the body be shaped to fit comfortably in a fist with the barrel extending from between the fingers as shown in FIG. 5. Cap 15 provides a secure surface for the rear of the cartridge to recoil against when the gun is fired, thereby spreading such force over a larger area of the plastic handle.

Firing pin handle 17 is also preferably molded of plastic and is molded about firing pin 16 and mounting pins 20 and 21. Enlarged portions 20*a* and 21*a* of pins 20 and 21, and washer 16*a* on firing pin 16 ensure that they are held firmly in place in handle 17. Pins 20 and 21 pass through apertures in plate 25 as does firing pin 16. Washers 26 held in place on mounting pins 20 and 21 by crimps 27 keep handle 17 and plate 25 from separating. Plate 25 is secured to body 12 by screws 28. Holes 29 and 30 in handle 17 allow access to these screws. With plate 25 secured to body 12, handle 17 is secured to the body by pins 20 and 21 and is kept from rotating with relation to the body. Wells 31 and 32 in body 12 allow free movement of pins 20 and 21, respectively, to allow handle 17 to be moved toward body 12.

A spring 33 may be provided in hole 18 between the base of cap 15 and washer 34 which rests against shoulder 35 of firing pin 16 in order to bias firing pin 16 and handle 17 away from body 12.

Barrier 22 is spaced preferably about one-quarter to three-eighths of an inch from the cartridge primer and is made of a material, such as plastic, in proper thickness in the area contacted by the firing pin so that the firing pin will penetrate the barrier when a predetermined pressure is applied to it. For an embodiment designed to be held in a hand as shown, pressure of between about 25 to about 40 pounds should be required to be exerted between handle 17 and body 12 before the firing pin penetrates barrier 22. The material is such that penetration is sudden upon reaching the predetermined pressure. Thus, once penetration occurs there is minimal resistance to further travel of the firing pin.

Due to the buildup of pressure necessary before the barrier is penetrated, once the firing pin has broken through the barrier it will move rapidly and with great force through the space between the barrier and the cartridge primer until it strikes and detonates the cartridge primer, thus firing the bullet.

The barrier 22 may be of uniform thickness throughout or may be of lesser thickness in the area contacted by the primer, as shown. The barrier should not be such as to allow a piece thereof to break away and separate from the strip as the firing pin penetrates it. Such separation could interfere with proper operation of the firing pin.

Rather than being in the form of a strip, barrier 22 may optionally be of rod or bar construction. If a rod or bar is used, a hole of similar cross section to that of the rod or bar would take the place of the slot through cap 15. It might be necessary or desirable, depending upon the rod or bar material, to notch it at the point where firing pin 16 contacts it to allow it to be more easily broken.

It will be realized that the firing pin handle is merely a way that pressure can be applied to the firing pin to force it through the barrier and can take many forms, either secured to the body with or without being secured to the firing pin, or merely being secured to the firing pin. Also, pressure could be applied to the firing pin otherwise than through a handle.

The cartridge used may employ either a rim-fire or center-fire primer. The embodiment shown is for use with a center-fire primer where the firing pin 16 is lined up with and adapted to strike the center of the cartridge. If a rim-fire primer is to be used, the firing pin must be offset so as to strike the rim of the cartridge.

A safety device 36 is preferably provided for attachment to the portion of firing pin 16 exposed between handle 17 and plate 25. Deformable split ring 37 snaps around the firing pin as shown in FIG. 2 and is approximately the same thickness as the space between the handle and plate so that the handle cannot be depressed when the safety device is in place. Ring 38 is rotatably secured to safety 36 so that it may be folded flat against handle 17 as shown in FIG. 1 to be out of the way or may be rotated to extend away from the gun body as shown in FIG. 2 to facilitating removal of the safety. Ring 38 in folded position preferably extends slightly past the outside edge of the handle as shown in FIG. 1 so that it may be easily and quickly rotated and used to remove the safety device from the firing pin by pulling it.

A strip 40 of hooked fastening material of a hook and loop type material such as that sold under the trademark Velcro may be attached to body 12, preferably on the side opposite ring 38, although for convenience of illustration it is shown in FIG. 1 on the same side as ring 38. The strip is not shown in FIGS. other than FIG. 1. This strip allows the firearm to be advantageously placed on the inner surface of a coat if of looped material, or removably secured to some other desired surface, particularly one that has a mating strip of looped material secured thereto.

The surface of body 12 and handle 17 is preferably textured to provide for a good grip thereof. The preferred embodiment described above is primarily adapted for use as a last resort, easily hidden, single-shot firearm to be used at close range. It is expected that it would be used once and then discarded, however, the body could be designed so that the cartridge could be removed and replaced.

Whereas the invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A single-shot, hand-held firearm, adapted for use with a cartridge having a primer, comprising a body; a barrel secured to said body, said barrel being adapted to receive and hold the cartridge; a firing pin normally spaced from the cartridge but adapted to be moved toward the cartridge so that it strikes the primer thereof; barrier means immediately adjacent the firing pin in its normal unfired, but ready to be fired, position and interposed between the firing pin and the primer of the cartridge in spaced relationship from said primer, said barrier means being adapted to stop movement of the firing pin toward said primer and hold said firing pin spaced from said primer until a predetermined pressure is applied by the firing pin against the barrier means so that said firing pin abruptly penetrates said barrier means, said firing pin being otherwise unimpeded in its travel path toward the primer when the firearm is ready to be fired; and means by which sufficient pressure can be applied to the firing pin whereby the firing pin abruptly penetrates the barrier means, passes through the space between the barrier means and the primer of the cartridge, and strikes the primer with sufficient force to detonate said primer, thereby causing the firearm to fire.

2. A firearm according to claim 1, wherein the means by which pressure is applied to the firing pin is an enlarged handle associated with the end of the firing pin opposite that adapted to contact the primer and which transmits pressure applied to the handle to the firing pin.

3. A firearm according to claim 2, wherein the handle is movably secured to the body so that it may be moved toward the body thereby moving the firing pin through the barrier means and into contact with the primer.

4. A firearm according to claim 3, wherein the body and handle are adapted to be held in a closed fist with the barrel protruding between two fingers, and the handle is adapted to be moved so as to force the firing pin through the barrier means by applying pressure to said handle by squeezing the firearm in the fist.

5. A firearm according to claim 4, wherein the barrier means is penetrated by the firing pin when a selected grip pressure of between about 25 to about 40 pounds is applied.

6. A firearm according to claim 2, wherein safety means are provided to prevent the firing pin from accidentally penetrating the barrier means when the safety means is in place.

7. A firearm according to claim 6, wherein the safety means comprises spacer means placed between the handle and the body for preventing movement of said handle towards said body.

8. A firearm according to claim 1, wherein the open end of the barrel means is enclosed in a sheath through which the bullet can be fired.

9. A firearm according to claim 1, wherein the barrel having a cartridge seated therein is received by cap means which encloses the primer end of said cartridge except for an opening in said cap means which allows the firing pin to contact the primer of said cartridge.

10. A firearm according to claim 9, wherein the cap means is adapted to receive and hold the barrier means.

11. A firearm according to claim 1, wherein safety means are provided to prevent the firing pin from accidentally penetrating the barrier means when the safety means is in place.

12. A firearm according to claim 1, wherein a velcro strip is secured to the body means to allow the firearm to be removably secured to any desired surface having velcro receiving material attached thereto.

* * * * *